US006325921B1

(12) United States Patent
Andersen

(10) Patent No.: US 6,325,921 B1
(45) **Date of Patent: *Dec. 4, 2001**

(54) METHOD FOR CATALYTIC REMOVAL OF METAL COMPOUNDS FROM HEAVY OILS

(76) Inventor: Kjeld Andersen, Am Moor 9, D-25588 Mehlbek (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/369,250

(22) Filed: Aug. 5, 1999

(30) Foreign Application Priority Data

Aug. 6, 1998 (DE) ..... 198 35 479

(51) Int. Cl.[7] ..... C10G 29/06
(52) U.S. Cl. ..... 208/253; 208/226; 208/287
(58) Field of Search ..... 208/251 R, 253, 208/226, 287, 295, 296

(56) References Cited

U.S. PATENT DOCUMENTS

| | | | | |
|---|---|---|---|---|
| 3,453,206 | | 7/1969 | Gatsis . | |
| 3,586,621 | | 6/1971 | Pitchford et al. . | |
| 3,733,259 | | 5/1973 | Wilson et al. . | |
| 3,983,027 | | 9/1976 | McCollum et al. . | |
| 4,381,993 | * | 5/1983 | Nevitt | 208/217 |
| 4,446,012 | | 5/1984 | Murthy et al. . | |
| 4,743,357 | | 5/1988 | Patel et al. . | |
| 5,284,577 | * | 2/1994 | Shih et al. | 208/251 H |

FOREIGN PATENT DOCUMENTS 0 402 405 B1 12/1993 (EP) .

* cited by examiner

*Primary Examiner*—Bekir L. Yildirim
(74) *Attorney, Agent, or Firm*—Pillsbury Winthrop LLP

(57) ABSTRACT

The invention relates to a method for catalytic removal of metal compounds from heavy oils, in which a catalyst with a content of a metal of group IVB and a metal of group IA of the periodic system is used, at temperatures between 300 and 550° C. and at a pressure between 100 and 300 atm.

5 Claims, No Drawings

METHOD FOR CATALYTIC REMOVAL OF METAL COMPOUNDS FROM HEAVY OILS

FIELD OF THE INVENTION

The invention relates to a method for catalytic removal of metal compounds from heavy oils.

Description of the Related Art

A large proportion of known oil reserves in the world are in the form of so-called heavy oils; as an example, it can be noted that for Venezuela alone, the quantity of recoverable heavy oil is estimated at 270 billion barrels.

Heavy oils as a rule contain metal compounds, often in large quantities, and especially vanadium and nickel. Because of these metal compounds, the use of heavy oils is generally restricted to their use as fuel.

There are a great many commercial methods available for reducing or concentrating metals in heavy oils. These methods can be subdivided into thermal methods, such as visbreaking, coking, and delayed coking, along with mild hydrotreatment or conversion to combustion gases, on the one hand, and catalytic processes such as hydrocracking and catalytic cracking, on the other.

In thermal methods, temperatures of more than 500° C. are needed; furthermore, these methods lead to the production of great amounts of coke. In the thermal methods, the metals become concentrated in the coke being formed. In the catalytic methods, the need for hydrogen under high pressure is very great, and the costs for the plants are therefore equally high. Since the metals are precipitated predominantly onto the catalysts, the consumption of catalysts is also very high.

Especially for removing metal compounds from heavy oils, methods using supercritical water are employed commercially; they are based on the fact that in the vicinity of the critical point of water (374.1° C.;218.3 atm), the properties of the water change very quickly as a function of temperature and pressure. This "supercritical water" has completely different dissolution properties from normal water; an especially notable fact is that the solution performance for nonpolar organic compounds such as heavy hydrocarbons rises sharply, because these compounds are soluble in water under supercritical conditions. This is of major significance for chemical reactions, since in the reactions of heavy oils in water, only one phase exists. However, in the treatment of heavy oils with water, there is one limiting factor, because heavy oils contain compounds that form coke very rapidly. The upper temperature limit must therefore as a rule be below 440° C., to prevent excessive coke formation, which would lead to stopping up of the reactor systems. Methods for removing or concentrating metal compounds from heavy oils in the presence of water near the critical point are described for instance in U.S. Pat. Nos. 3,983,027, 3,453,206, 3,733,259, 3,586,621, 4,446,012, and 4,743,357. In these methods, the metals from the unprocessed heavy oil are typically present, after the treatment, in unconverted form usually in the heaviest portion of the outflowing oil product. This can be ascertained from the refraction properties of the organometallic compounds.

In U.S. Pat. No. 4,446,012, for instance, a noncatalytic method is described, in which Boscan heavy oil from Venezuela at a temperature of 410 ° C. and a pressure of 140 bar was used as the supply; it had a density (API) of 10.3 and a vanadium and nickel content of 1500 and 100 ppm, respectively. After the treatment with water at supercritical conditions, the outflowing oil was separated into two fractions, one with a boiling point below 343° C. and soluble in pentane, which made up 64.6 weight % of the original fraction and represented the light fraction after conversion, and a second fraction with a boiling point of over 343° C., which was insoluble in pentane, represented 22.2 weight % of the original fraction, and was called the heavy fraction. The untreated heavy starting oil originally contained approximately 15 weight % that met the definition of a light fraction. After the treatment, vanadium and nickel contents of 7.8 ppm and 1.2 ppm, respectively, were found in the light fraction, while in the heavy fraction a concentration of vanadium and nickel to 5900 ppm and 600 ppm, respectively, had taken place.

It is therefore possible and known to concentrate metal compounds in the heavy fractions of heavy oil, if the oil is treated with water in the vicinity of the critical point.

One disadvantage of these known methods, however, is that the metals in fact collect predominantly in the heavy fraction, which means that this heavy fraction requires further special, and complicated, treatment before it can be used commercially in any way at all. Such fractions enriched with metals also represent a severe problem from the standpoint of environmental protection.

There is accordingly still a demand for methods for catalytic removal of metal compounds from heavy oils that overcomes the problems of the previously known methods. For attaining this object, a method is proposed which is characterized in that a catalyst with a content of a metal of group IVB and a metal of group IA of the periodic system is used, at temperatures between 300 and 550° C. and at a pressure between 100 and 300 atm.

BRIEF SUMMARY OF THE INVENTION

Completely surprisingly, it has now been demonstrated that heavy metal compounds can be removed from heavy oils with excellent yields and effective reduction of the metal contents and with avoidance of the passage of the metal compounds into the heavy fraction of the outflowing oil, if a specific type of catalyst is employed.

Catalysts from compounds of group IVB and IA of the periodic system are known from European Patent Disclosure EP 0 402 405, but in that case they are intended for use in gasification processes for organic substances. Zirconium oxide, which is stable at the relatively high temperatures, is preferably used as the compound from group IVB. The compound from group IA that is preferably used is potassium carbonate, but it can also be replaced with other potassium salts. Other metal compounds of group IA and IVB can also be used; the ratio of compounds of group IA to those of group IVB should be in the range from approximately 0.01:1 to 0.5:1.

The methods of the invention are preferably performed with a fixed bed catalyst in the reactor, specifically in such a way that zirconium oxide in the form of granulate or tablets, impregnated with potassium carbonate, is employed.

The invention offers the advantage that an effective metal removal is accomplished, and no enrichment of the metal compounds in the heavy fraction of the outflowing oil takes place. The separate treatment and disposal of this heavy phase is therefore dispensed with.

DETAILED DESCRIPTION OF THE INVENTION

The invention will now be described in further detail in terms of examples:

EXAMPLE 1

Water and heavy oil in a ratio by weight of 2:1 were continuously supplied to a reactor with a volume of 0.5 L and with a fixed bed catalyst of zirconium oxide that had been impregnated with potassium carbonate. The density (API) of the heavy oil was 10.8; the vanadium and nickel content was 790 and 85 ppm, respectively.

The catalytic demetallization was performed at a pressure of 225 bar and a temperature of 480° C. during a period of 30 minutes; the oil feed rate (LHSV) was 1000 ml/h.

The outflowing oil fraction was not separated off; instead, a metal analysis of this total fraction was performed; it shown a content of vanadium and nickel of 6 ppm and 2 ppm, respectively.

The yield was more than 99% in terms of metal removal. The determinations of the vanadium and nickel were done in a manner known per se by atom absorption spectroscopy.

EXAMPLE 2

A residue from petroleum distillation under atmospheric pressure and water were continuously supplied to a weight ratio of 0.9:1 in a reactor with a volume of 0.5 L and with a solid catalyst of zirconium oxide that was impregnated with potassium carbonate. The distillation residue had a density (API) of 12.6 and a vanadium content of 7.0 ppm and a nickel content of 2.0 ppm. The demetallization was done at a pressure of 225 bar and a temperature of 460° C. for a period of 30 minutes.

The outflowing fraction was not separated into a light and a heavy fraction but instead a metal analysis of the total fraction was made, which showed a content of vanadium and nickel of 0.2 and 0.1 ppm, respectively.

This example shows that even fractions with a relatively modest content of organometallic compounds can be treated according to the invention, and a practically complete removal of the problematic organometallic compounds, especially vanadium and nickel compounds, takes place.

It should be emphasized in particular that when the method of the invention is performed, even when different starting fractions are used practically no coke formation occurs, while the metal compounds are separated off efficiently.

What is claimed is:

1. A method for catalytic removal of metal compounds from heavy oils, characterized in that a catalyst with a content of a metal of group IVB that is impregnated with a metal of group IA of the periodic system is used, at temperatures between 300° C. and 550° C. and at a pressure between 100 atm and 300 atm.

2. The method of claim 1, characterized in that zirconium dioxide is used as the metal compound of group IVB of the periodic system.

3. The method of claim 1 or 2, characterized in that a potassium compound is used as the metal compound of group IA of the periodic system.

4. The method of claim 3, characterized in that the potassium compound is added continuously to the starting oil during the reaction.

5. The method of claim, characterized in that the conversion takes place at temperatures between 400 and 500° C. and at a pressure between 150 and 250 atm.

* * * * *